US006654584B2

(12) United States Patent
Aslam et al.

(10) Patent No.: US 6,654,584 B2
(45) Date of Patent: Nov. 25, 2003

(54) PRESSURE ROLLER CLEANER FOR A REPRODUCTION APPARATUS FUSER ASSEMBLY

(75) Inventors: Muhammed Aslam, Rochester, NY (US); Fangsheng Wu, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/991,584

(22) Filed: Nov. 17, 2001

(65) Prior Publication Data

US 2003/0095817 A1 May 22, 2003

(51) Int. Cl.[7] ..... G03G 15/20
(52) U.S. Cl. ..... 399/326; 399/327
(58) Field of Search ..... 399/324–327; 118/60

(56) References Cited

U.S. PATENT DOCUMENTS 5,047,809 A * 9/1991 Owada et al. ..... 118/60 X
5,160,970 A * 11/1992 Isogai ..... 118/60 X
5,512,729 A * 4/1996 Kusaka et al. ..... 399/327 X
6,243,558 B1 * 6/2001 Oota ..... 399/326

* cited by examiner

*Primary Examiner*—William J. Royer
(74) *Attorney, Agent, or Firm*—Lawrence P. Kessler

(57) ABSTRACT

A fuser assembly for an electrostatographic reproduction apparatus including a fuser member and a pressure member, a release oil oiler system for the fuser assembly, and a cleaner for cleaning the pressure member. The pressure member cleaner has a cleaning member including a fabric material. A drive mechanism is associated with the cleaning member for moving the cleaning member relative to the pressure member such that the cleaning member is located in operative association with the pressure member, or the cleaning member is located in spaced relation remote from the pressure member. A logic and control unit selectively activates the drive mechanism to move the cleaning member to the operative association location or the remote location.

9 Claims, 1 Drawing Sheet

PRESSURE ROLLER CLEANER FOR A REPRODUCTION APPARATUS FUSER ASSEMBLY

FIELD OF THE INVENTION

This invention relates in general to a fuser assembly for a reproduction apparatus, and more particularly to a pressure roller cleaner for a reproduction apparatus fuser assembly.

BACKGROUND OF THE INVENTION

In typical commercial reproduction apparatus (electrostatographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly for typical electrographic reproduction apparatus includes at least one heated roller, having an aluminum core and an elastomeric cover layer, and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

Certain reproduction apparatus recently introduced into the market have been designed to produce multi-color copies. In such reproduction apparatus, multiple color separation images are respectively developed with complementary colored marking particles, and then transferred in superposition to a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fusing oil to the heating roller, the use of such oil introduces further complications into the fusing system, such as handling of the oil and making sure that the layer of oil on the roller is uniform. Alternatively, a mechanical arrangement for reducing image offset, without the need for fusing oil, has been found. Such mechanical arrangement provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing, but is not particularly suitable for black image fusing.

With roller fuser assemblies, it is common practice to use release fluids, such as silicone oil for example, applied to the fuser roller surface to improve the release of image-carrying receiver members from the fuser roller. The most common types of release fluid applicators or oilers are a rotating wick roller, a donor/metering roller, an oil impregnated oiling web, an oil impregnated oiling pad or roller, or variations or combinations of the above. The release oil applied to the fuser roller tends to migrate from the fuser roller to the opposing pressure roller. This occurs, for example, between receiver members passing through the fuser assembly. Oil on the pressure roller can be deposited on subsequent receiver members transported through the fuser assembly. This may lead to undesirable, deleterious artifacts on the copies being reproduced, such that the copies are degraded to the extent that makes them unacceptable for intended use.

SUMMARY OF THE INVENTION

According to this invention there is provided a fuser assembly for an electrostatographic reproduction apparatus including a fuser member and a pressure member, a release oil oiler system for said fuser assembly, and a cleaner for cleaning the pressure member. The fuser member and pressure member are locatable in operative association to apply heat and pressure to a marking particle image carried by a receiver member to fix such marking particle image to the receiver member as the receiver member is transported between the fuser member and pressure member. The pressure member cleaner has a cleaning member including a fabric material adapted to be impregnated with release oil. A drive mechanism is associated with the cleaning member for moving the cleaning member relative to the pressure member such that the cleaning member is located in operative association with the pressure member, or the cleaning member is located in spaced relation remote from the pressure member. A logic and control unit selectively activates the drive mechanism to move the cleaning member to the operative association location or the remote location.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
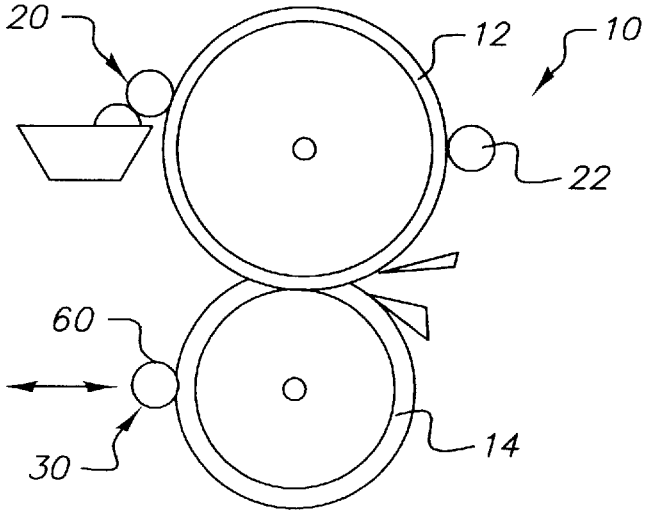
FIG. 1 is a schematic side elevational view of an electrostatographic reproduction apparatus fusing assembly including an oiler mechanism and a pressure member cleaning mechanism according to this invention.

Referring to the accompanying drawings, FIG. 1 schematically shows an electrographic reproduction apparatus fuser assembly including a fusing member, a pressure member, a release oil device, and a pressure member cleaner according to this invention. The fuser assembly, designated generally by the numeral 10, has a fusing member 12 in the form of a roller, although a belt, sleeve, or any other variation thereof would be applicable with this invention. The fusing member 12 is heated by a suitable heating mechanism (not shown), and is located in nip relation with a pressure member 14. The pressure member 14 is also shown as being in the form of a roller, and may similarly be a belt, sleeve, or any other variation thereof. The fusing nip between the fusing member 12 and the pressure member 14 is associated with the receiver member travel path of the reproduction apparatus. That is, as a receiver member bearing a marking particle image is transported along the travel path with the nip between the members 12, 14, the marking particle image is fixed to the receiver member by application of heat and pressure in the fusing nip before the receiver member is delivered from the travel path to an output device or a duplex reproduction recirculation path.

The release oil device for the fuser assembly 10 is designated generally by the numeral 20. The release oil device 20 is illustrated as being of the donor roller type, but any other suitable oiler system may be employed. The release oil device 20 delivers release oil to the surface of the fusing member 12 to substantially prevent offset of marking particles from a marking particle-developed image to the fusing member 12 during the process of fusing of such marking particle image to a receiver member. Additionally a cleaner 22 is provided for the fusing member 12. The fusing member cleaner 22 (e.g., a blade, web, roller) removes any residual marking particles or dust from the fusing member 12 to substantially prevent undesirable image artifacts, caused by such particles or from in the reproduction.

With the fuser assembly 10 of this embodiment, the fusing member 12 and the pressure member 14 are internally heated. As noted, the release oil device 20 serves to apply release oil to the fusing member 12 to substantially prevent any marking particle offset onto the fusing member 12. The pressure member 14 is not oiled directly. However, the pressure member 14 may receive some residual release oil which migrates from the fusing member 12 during the interframe between successive receiver members having marking particle images respectively being fused thereto. It has been known that during fusing of duplex (two-sided) reproductions, the side of the receiver member bearing the marking particle image that comes in contact with the pressure member 14 may tend to show some image artifacts due to such residual release oil transferred to the pressure member 14. Further, some of the residual release oil may be carried out of the fuser assembly 10 by the fused receiver member to potentially contaminate other elements of the reproduction apparatus. Accordingly, the residual release oil from the pressure member 14 needs to be removed, or smoothed out, before the receiver member bearing the marking particle image comes in contact with the pressure member 14. In prior electrostatographic reproduction apparatus, cleaning webs for the pressure members or a foam roller contacting the pressure member 14 have been used.

Figure 2:
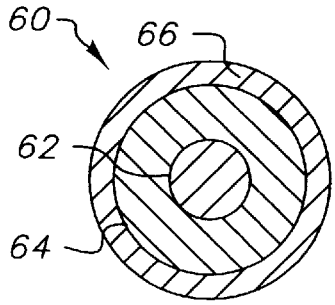
FIG. 2 is a schematic side elevation view of the cleaning roller of the pressure cleaning mechanism of FIG. 1, partly in cross-section with portions removed to facilitate viewing.
Figure 3:
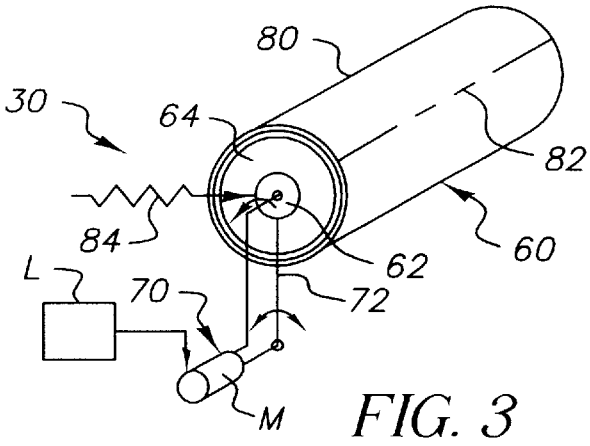
FIG. 3 is a view in perspective of the pressure member cleaning mechanism, according to this invention, including a device for selectively moving the cleaning roller relative to the fuser assembly pressure member.

According to this invention, the pressure member cleaning device, designated generally by the numeral 30, includes a cleaning roller 60 having a substantially rigid steel or aluminum core 62. The core 62 is surrounded by a compliant layer 64 covered with a fabric material 66 (see FIG. 2). The fabric material 66 is preferably, for example, high strength non-woven polyester, or non-woven polyester coated with PTFE. The fabric material 66 is preferably a renewable sheet in the form of a single sheet, or a plurality of single sheet layers located one over another. Alternatively, the sheets could be in the form of an elongated web 80 wound about the compliant layer 64 of the cleaning roller 60 (see FIG. 3). Sheets of the elongated web 80 are respectively divided by transverse perforated lines 82 which define the individual sheets and facilitate separation of one sheet from a subsequent sheet.

The cleaning roller 60 of the pressure member cleaning device 30 serves to clean the pressure member 14 and apply some release oil onto the surface of the pressure member 14 as needed to maintain a uniform mono-layer of release oil on the surface thereof. By so doing, residual release oil induced artifacts on the side of the receiver member contacting the pressure member 14 are substantially prevented. The fabric material 66 of the cleaning roller 60 picks up residual release oil, or has some small amount of release oil impregnated in it so that it can apply a very thin uniform layer of release oil on the pressure member 14 where there is no residual release oil. This serves to reduce contact friction and hence the wear of the pressure member surface, and to clean the excess residual oil from the pressure member 14.

After a suitable period of use, the sheet fabric material 66 of the cleaning roller 60 becomes sufficiently contaminated to prevent adequate cleaning of the pressure member 14, and application of the thin layer of release oil. At that time, such sheet is replaced with a new sheet, or torn off at a perforation line 82 (FIG. 3) to expose a new sheet. An air cylinder or spring (designated generally by the arrow 84 in FIG. 3) may be used to compensate for the diameter change in the instance of the long-web type cleaner as the web is used up.

An actuating mechanism 70 serves to bring the cleaning roller 60 into contact with the pressure member 14, and rotates the cleaning roller 60 in the opposite direction to that of the pressure member 14. The actuating mechanism 70 includes any suitable well known motor M and linkage system (designated by the numeral 72 in FIG. 2), or by any type of equivalent electrical components. In operation, the actuating mechanism 70 is controlled by a microprocessor-based logic and control unit L to selectively act to cause the cleaning roller 60 to engage the pressure member 14 only during the fusing of duplex marking particle images. The cleaning roller 60 otherwise is urged to stay disengaged from the pressure member 14; for example, during a stand-by mode, or during the making of simplex (one-sided) reproductions. Therefore, no additional release oil is applied to the pressure member 14, which may be carried out with the receiver members to contaminate other components of the electrostatographic reproduction apparatus such as the photoconductor, the transfer member, and chargers for example.

The invention has been described in detail with particular reference to preferred embodiments thereof, but it will be understood that variations and modifications can be effected within the spirit and scope of the invention.

What is claimed is:

1. A fuser assembly for an electrostatographic reproduction apparatus, said fuser assembly including a fuser member and a pressure member locatable in operative association to apply heat and pressure to a marking particle image carried by a receiver member to fix such marking particle image to said receiver member as said receiver member is transported between said fuser member and pressure member, a release oil oiler system for said fuser assembly, and a cleaner for cleaning said pressure member, said pressure member cleaner comprising:

a cleaning member including a fabric material adapted to be impregnated with release oil;

a drive mechanism associated with said cleaning member for moving said cleaning member relative to said pressure member such that said cleaning member is located in operative association with said pressure member, or said cleaning member is located in spaced relation remote from said pressure member; and a logic and control unit for selectively activating said drive mechanism to move said cleaning member to said operative association location or said remote location.

2. The fuser assembly according to claim 1 wherein said cleaning member is a roller mounted to be selectively moved into and out of contact with said pressure member, or out of contact with said pressure member by said drive mechanism.

3. The fuser assembly according to claim 2 wherein said cleaning member roller includes a substantially rigid core covered with at least one layer of fabric material.

4. The fuser assembly according to claim 3 wherein said at least one layer of fabric material includes a plurality of layers located one over another.

5. The fuser assembly according to claim 3 wherein said at least one layer of fabric material includes a wound elongated web divided by transverse perforated lines which define respective individual sheets and facilitate separation of one sheet from a subsequent sheet.

6. The fuser assembly according to claim 2 wherein transport of said receiver member is due to rotation of said pressure member, and wherein said cleaning member roller is rotated by said drive mechanism in a direction such that the surface thereof moves in the opposite direction to that of said pressure member.

7. The fuser assembly according to claim 6 wherein said logic and control unit selectively activates said drive mechanism to move said cleaning member to said operative association location only when said reproduction apparatus is in a duplex copy cycle.

8. In association with a fuser assembly for an electrostatographic reproduction apparatus having an operating cycle for producing simplex copies and an oPerating cycle for producing duplex copies, said fuser assembly including a fuser member and a pressure member in operative association to apply heat and pressure to a marking particle image carried by a receiver member to fix such image to said receiver member as said receiver member is transported between said fuser member and pressure member, an applicator for applying release oil to said fuser member, and a pressure member cleaning member, a method for controlling the action of said pressure member cleaning member comprising the steps of:

providing said pressure member cleaning member with a replaceable fabric layer;

selectively activating said pressure member cleaning member to engage said pressure member so that said fabric layer serves to smooth out release oil on said pressure member and clean said pressure member; and when used up, replacing said pressure member cleaning member fabric layer.

9. The method for controlling the action of said pressure member cleaning member according to claim 8 wherein the step of selectively activating said pressure member cleaning member occurs only during the electrostatographic reproduction apparatus operating cycle for producing duplex copies.

* * * * *